US006607996B1

(12) United States Patent
Matsunaga et al.

(10) Patent No.: US 6,607,996 B1
(45) Date of Patent: Aug. 19, 2003

(54) BIODEGRADABLE FILAMENT NONWOVEN FABRIC AND METHOD OF PRODUCING THE SAME

(75) Inventors: Mamiko Matsunaga, Okazaki (JP); Atsushi Matsunaga, Okazaki (JP); Koichi Nagaoka, Osaka (JP)

(73) Assignees: Tomoegawa Paper Co., Ltd., Tokyo (JP); Unitika, Ltd., Hyogo (JP)

( * ) Notice: Subject to any disclaimer, the term of this patent is extended or adjusted under 35 U.S.C. 154(b) by 0 days.

(21) Appl. No.: 09/351,413

(22) Filed: Jul. 9, 1999

Related U.S. Application Data

(63) Continuation-in-part of application No. 08/715,900, filed on Sep. 19, 1996, now abandoned.

(30) Foreign Application Priority Data

| | | |
|---|---|---|
| Sep. 29, 1995 | (JP) | 7-251679 |
| Oct. 3, 1995 | (JP) | 7-256079 |
| Oct. 3, 1995 | (JP) | 7-256080 |
| Oct. 3, 1995 | (JP) | 7-256083 |
| Jan. 19, 1999 | (JP) | 11-009965 |

(51) Int. Cl.[7] ..... D04H 3/00

(52) U.S. Cl. ..... 442/327; 442/334; 442/361; 442/414

(58) Field of Search ..... 428/224, 221; 528/354; 442/327, 334, 361, 414

(56) References Cited

U.S. PATENT DOCUMENTS

| | | | | |
|---|---|---|---|---|
| 3,616,157 A | * | 10/1971 | Smith | 428/198 |
| 3,843,609 A | * | 10/1974 | Kimura et al. | |
| 5,437,918 A | * | 8/1995 | Taniguchi et al. | 428/224 |
| 5,688,582 A | * | 11/1997 | Nagaoka et al. | 428/198 |

FOREIGN PATENT DOCUMENTS

| | | | |
|---|---|---|---|
| EP | 0 597 427 A1 | | 5/1994 |
| EP | 0 765 959 A1 | | 4/1997 |
| FR | 2725731 | * | 4/1997 |
| JP | 5 214648 Patent | | 8/1993 |
| JP | 06-212548 | * | 8/1994 |
| JP | 6 212548 Patent | | 8/1994 |
| JP | 7 034369 Patent | | 2/1995 |
| JP | 7 048769 Patent | | 2/1995 |
| JP | 7 125128 Patent | | 5/1995 |
| JP | 07-133511 | * | 5/1995 |
| JP | 95848 | * | 4/1997 |
| JP | 9-95849 | * | 4/1997 |
| JP | 9-95850 | * | 4/1997 |
| JP | 9-95851 | * | 4/1997 |
| WO | WO 98 50611 | | 11/1998 |

OTHER PUBLICATIONS

Khan et al., International Nonwovens Journal, vol. 7, No. 2 69–73, 1995.*

Masao Matsui, Shimadzu Corp. Kyoto/Japan, Biodegradable Fibers Made of Poly–Lactic Acid; Oct., 1996, Chemical Fibers International, vol. 46, pp. 318–319.

European Search Report dated Jan. 19, 2000, by Examiner R. Barathe.

Annex to the European Search Report on European Patent Application No. EP 99 11 0694 dated Jan. 19, 2000.

* cited by examiner

*Primary Examiner*—Jeffrey Mullis
(74) *Attorney, Agent, or Firm*—Harness, Dickey & Pierce, P.L.C.

(57) ABSTRACT

A biodegradable filament nonwoven fabric is provided which is composed of filaments of a polylactic acid based polymer. The polylactic acid based polymer is selected from the group consisting of poly-D-lactic acid, poly-L-lactic acid, copolymers of D-lactic acid and L-lactic acid, copolymers of D-lactic acid and a hydroxycarboxylic acid, copolymers of L-lactic acid and a hydroxycarboxylic acid, and copolymers of D-lactic acid, L-lactic acid and a hydroxycarboxylic acid, which have melting points of not lower than 100° C., and blends of any of these polymers which have melting points of not lower than 100° C. The filaments of the polylactic acid based polymer have a birefringence of $10\times10^{-3}$ to $25\times10^{-3}$, a degree of crystallinity of 12 to 30 wt %, and a crystal size of not greater than 80 Å as measured axially of the filaments. The nonwoven fabric has a boiling water shrinkage percentage of not higher than 15%.

22 Claims, No Drawings

BIODEGRADABLE FILAMENT NONWOVEN FABRIC AND METHOD OF PRODUCING THE SAME

CROSS-REFERENCE TO RELATED APPLICATIONS

This is a continuation-in-part application of application Ser. No. 08/715,900, filed Sep. 19, 1996, now abandoned and takes priority from Japanese Application No. 11-9965, filed Jan. 19, 1999.

FIELD OF THE INVENTION

The present invention relates to a biodegradable filament nonwoven fabric which is degradable by microorganisms and the like in natural environments, and to a method of producing the same. Particularly, the invention relates to a biodegradable filament nonwoven fabric which is obtainable from a polylactic acid based polymer under specific conditions, and to a method of producing the same.

BACKGROUND OF THE INVENTION

Hitherto, nonwoven fabrics which are degradable by microorganisms and the like have been known, examples thereof including degradable nonwoven fabrics composed of natural or regenerated fibers or filaments such as of cotton, flax, hemp, ramie, wool, rayon, chitin and alginic acid.

However, such degradable nonwoven fabrics, which are generally hydrophilic and water absorptive, are not suitable for use in such an application as disposable diaper top sheet which should have hydrophobic and less water absorptive properties and provide a dry tactile feeling even in a wet or moistened state. These nonwoven fabrics are much liable to deterioration in strength and dimensional stability under wet and moistened environmental conditions and, hence, find limited application in the general industrial material field. Further, the nonwoven fabrics are not thermoformable because of their non-thermoplastic property and, hence, are inferior in processability.

Therefore, positive research and development have recently been made on microbially degradable filaments which are obtainable by the melt spinning technique from microbially degradable polymers having thermoplastic and hydrophobic properties, and on microbially degradable nonwoven fabrics composed of such filaments. In particular, a group of polymers generally called aliphatic polyesters are attracting high attention because they are microbially degradable. Specific examples of such polymers include poly-β-hydroxyalkanoates as typical microbially degradable polyesters, poly-ω-hydroxyalkanoates such as polycaprolactone, polyalkylene alkanoates such as polybutylene succinate which are polycondensates of a glycol and a dicarboxylic acid, and copolymers of these polymers. In recent development of a new polymerization process which ensures efficient production of polymers of high polymerization degree, various attempts have been made to produce filaments from poly-α-oxyacids such as poly-L-lactic acid and nonwoven fabrics composed of such filaments of the aforesaid aliphatic polyesters, polylactic acid in particular has a relatively high melting point, so that nonwoven fabrics composed of polylactic acid filaments are possibly useful in applications which require heat resistance. Therefore, much expectation is now directed toward practical application of the polylactic acid nonwoven fabrics.

For example, JP-A-7-126970 (1995) discloses a staple fiber nonwoven fabric composed principally of polylactic acid, and JP-A-6-212511 (1994) discloses a polylactic acid staple fibers useful for production of polylactic acid staple fiber nonwoven fabrics. However, the production of these staple fiber nonwoven fabrics involves many production steps from filament melt-spinning to nonwoven fabric formation, thereby posing a limitation to reduction in the production costs.

Further, JP-A-7-48769 (1995), JP-A-6-264343 (1994), International Nonwovens Journal, Vol. 7, No. 2, pp 69 (1995), and EP-A-0637641 suggest filament nonwoven fabrics produced from polylactic acid by a so-called spun-bond technique in which filaments are melt-extruded and deposited on a screen to form a web.

In JP-A-7-48769, however, a suggestion is simply made that a nonwoven fabric can be produced from a lactic acid polymer through the spun-bond technique, with no specific description given to the production process and the physical properties of the resulting nonwoven fabric. In JP-A-6-264343, which pertains to a microbially degradable filament aggregate for agricultural use, there is no detailed statement about critical production conditions such as a filament drafting speed and the like, nor any teaching on the physical properties of the resulting nonwoven fabric. The teaching of International Nonwovens Journal, Vol. 7, No. 2, pp 69 (1995) is merely such that a hard and brittle plate-like polylactic acid spun-bonded fabric was obtained. In EP-A-0637641, there is no teaching that a polylactic acid spun-bonded fabric excellent in flexibility and mechanical strength was produced.

SUMMARY OF THE INVENTION

It is an object of the present invention to provide a polylactic acid based filament nonwoven fabric which is degradable by microorganisms and the like in natural environments and excellent in mechanical strength and flexibility for practical use.

In accordance with a first aspect of the present invention to accomplish this object, there is provided a nonwoven fabric composed of monocomponent filaments of a polylactic acid based polymer, the polylactic acid based polymer being selected from the group consisting of poly-D-lactic acid, poly-L-lactic acid, copolymers of D-lactic acid and L-lactic acid, copolymers of D-lactic acid and a hydroxycarboxylic acid, and copolymers of L-lactic acid and a hydroxycarboxylic acid which have melting points of not lower than 100° C., and blends of any of these polymers which have melting points of not lower than 100° C., the polylactic acid based filaments having a birefringence of $10\times10^{-3}$ to $25\times10^{-3}$, a degree of crystallinity of 12 to 30 wt % and a crystal size of not greater than 80 Å as measured axially of the filaments, the nonwoven fabric having a boiling water shrinkage percentage of not higher than 15%.

In accordance with a second aspect of the present invention, there is provided a nonwoven fabric composed of modified cross-section or composite filaments of a polylactic acid based polymer, the polylactic acid based polymer being selected from the group consisting of poly-D-lactic acid, poly-L-lactic acid, copolymers of D-lactic acid and L-lactic acid, copolymers of D-lactic acid and a hydroxycarboxylic acid, copolymers of L-lactic acid and a hydroxycarboxylic acid, copolymers of D-lactic acid, L-lactic acid and a hydroxycarboxylic acid, which have melting points of not lower than 100° C., and blends of any of these polymers which have melting points of not lower than 100° C., the polylactic acid based filaments having a degree of crystallinity of 12 to 30 wt % and a crystal size of not greater than 80 Å as measured axially of the filaments, the nonwoven fabric having a boiling water shrinkage percentage of not higher than 15%.

In accordance with a third aspect of the present invention, there is provided a method of producing a nonwoven fabric composed of polylactic acid based filaments, the method comprising the steps of: melting a polylactic acid based polymer at a temperature of (Tm+20)° C. to (Tm+80)° C. (wherein Tm is the melting point of the polylactic acid based polymer) and extruding the resulting melt through a spinneret into filaments; drafting the resulting filaments at a drafting speed of 3,000 to 6,500 m/min by means of a suction device; spreading open each other and accumulating the drafted filaments on a movable collector surface thereby to form a web; and heat-treating the web; wherein the polylactic acid based polymer is selected from the group consisting of poly-D-lactic acid, poly-L-lactic acid, copolymers of D-lactic acid and L-lactic acid, copolymers of D-lactic acid and a hydroxycarboxylic acid, copolymers of L-lactic acid and a hydroxycarboxylic acid, and copolymers of D-lactic acid, L-lactic acid and a hydroxycarboxylic acid, which have melting points of not lower than 100° C., and blends of any of these polymers which have melting points of not lower than 100° C., and has a melt flow rate of 10 to 100 g/10 min as measured at 210° C. in conformity with ASTM-D-1238.

The polylactic acid based filament nonwoven fabrics according to the present invention are degradable by microorganisms and the like in natural environments, and excellent in mechanical strength and flexibility for practical use.

In the nonwoven fabrics of the present invention, the filaments are preferably partially bonded with heat and pressure. With this arrangement, the polylactic acid based filaments are partially bonded with heat and pressure without individual filaments being joined at their intersections so as to retain a nonwoven structure. Therefore, the nonwoven fabric is excellent in mechanical strength and flexibility for practical use unlike the known polylactic acid based nonwoven fabrics which are generally hard and brittle.

The nonwoven fabric of the present invention preferably has spot fusion-bonded areas in which some of temporary fusion-bonded spots preliminarily formed in parts of the web are de-bonded through a three-dimensional entanglement process, and non-fusion-bonded areas in which the filaments are three-dimensionally entangled with each other to be integrated. More specifically, the nonwoven structure is obtained by preliminarily forming temporary fusion-bonded spots in parts of the web and subjecting the web to the three-dimensional entanglement process to de-bond at least some of the temporary fusion-bonded spots and to three-dimensionally entangle the constituent filaments including the de-bonded filament portions. Therefore, the nonwoven fabric is excellent in mechanical strength, dimensional stability and flexibility for practical use unlike the known polylactic acid based nonwoven fabrics which are generally hard and brittle.

Alternatively, the nonwoven fabric of the present invention is preferably constructed such that the filaments are integrated by completely de-bonding temporary fusion-bonded spots once formed in parts of the web and three-dimensionally entangling the filaments through the three-dimensional entanglement process.

Alternatively, the nonwoven fabric of the present invention is preferably constructed such that at least one surface of a filament web is bonded with heat and pressure all over. With such a construction, the nonwoven fabric has a filmed surface portion and an inner nonwoven portion. The filmed surface portion imparts the nonwoven fabric with air- and water-shielding properties and a superior mechanical strength, while the inner nonwoven portion imparts the nonwoven fabric with a flexibility which is more excellent than an entirely filmed sheet. Therefore, the nonwoven fabric is a novel multifunction nonwoven fabric.

DESCRIPTION OF THE PREFERRED EMBODIMENTS

Filaments to be employed for the nonwoven fabric of the present invention are composed of a polylactic acid based polymer.

The polylactic acid based polymer is selected from the group consisting of poly-D-lactic acid, poly-L-lactic acid, copolymers of D-lactic acid and L-lactic acid, copolymers of D-lactic acid and a hydroxycarboxylic acid, copolymers of L-lactic acid and a hydroxycarboxylic acid, and copolymers of D-lactic acid, L-lactic acid and a hydroxycarboxylic acid, which have melting points of not lower than 100° C., preferably of not lower than 120° C., and blends of any of these polymers.

Where a homopolymer such as poly-D-lactic acid or poly-L-lactic acid is used as the polylactic acid based polymer, it is desirable that a plasticizer is added thereto particularly for enhancement of spinnability in the spinning process and improvement of flexibility of the resulting filaments and nonwoven fabric. Examples of the plasticizer include triacetin, lactic acid oligomers, and dioctyl phthalate. The amount of the plasticizer to be added is 1 to 30 wt %, preferably 5 to 20 wt %.

In the present invention, it is preferred, in terms of the heat resistance of the nonwoven fabric, that the constituent filaments of the nonwoven fabric have a melting point of not lower than 100° C. Therefore, it is important that the polylactic acid based polymer forming the filaments has a melting point of not lower than 100° C. The polylactic acid homopolymer such as poly-L-lactic acid or poly-D-lactic acid has a melting point of about 180° C. Where any of the aforesaid copolymers is used as the polylactic acid based polymer, it is important that the copolymerization molar ratio of monomeric components thereof is determined so that the copolymer has a melting point of not lower than 100° C. If the copolymerization molar ratio of L-lactic acid or D-lactic acid in the copolymer is beyond a range of D/L=100/0–90/10 and a range of D/L=10/90–0/100, the melting point of the polylactic acid based polymer and hence the melting point of the constituent filaments of the nonwoven fabric are lower than 100° C., or the resulting copolymer is an amorphous polymer. Accordingly, the quenchability of the filaments in the spinning process is lowered, and the resulting nonwoven fabric has a lower heat resistance. This poses limitations on application of the nonwoven fabric.

Where a copolymer of L- or D-lactic acid and a hydroxycarboxylic acid is used, examples of specific hydroxycarboxylic acids include glycolic acid, hydroxybutyric acid, hydroxyvaleric acid, hydroxypentanoic acid, hydroxycaproic acid, hydroxyheptanoic acid and hydroxyoctanoic acid, among which hydroxycaproic acid or glycolic acid is particularly preferred in terms of microbial degradability and cost economy.

Where the filaments of the polylactic acid based polymer are monocomponent filaments, the filaments are required to have a birefringence of $10\times10^{-3}$ to $25\times10^{-3}$, a degree of crystallinity of 12 to 30 wt % and a crystal size of not greater than 80 Å as measured axially of the filaments.

The birefringence represents the degree of molecular orientation. If the birefringence is lower than $10\times10^{-3}$ and the degree of crystallinity is lower than 12 wt %, the filaments have insufficient molecular orientation and an excessively low crystallinity, thereby having a higher residual extensibility. Therefore, a nonwoven fabric composed of such filaments is inferior in dimensional stability and mechanical properties and not suitable for practical use. Further, the nonwoven fabric lacks for heat stability and, therefore, liable to be shrunk when used in a high temperature environment.

On the contrary, if the filaments have a birefringence of greater than $25\times10^{-3}$, a degree of crystallinity of greater than 30 wt % and a crystal size of greater than 80 Å as measured axially of the filaments, the resulting nonwoven fabric is superior in dimensional stability, mechanical properties and heat stability, but has a higher stiffness. Therefore, the nonwoven fabric is inferior in flexibility, failing to achieve the object of the present invention.

That is, where the birefringence, the degree of crystallinity and the crystal size as measured axially of the filaments fall within the aforesaid ranges, the filaments are imparted with a relatively low crystallinity, and yet have crystallized regions in which crystals have sufficiently grown and oriented. Thus, the resulting nonwoven fabric is superior in dimensional stability, mechanical properties and thermal stability for practical use. Since the filaments also have amorphous regions with a lower crystal orientation degree, the filaments and hence the nonwoven fabric have an improved flexibility. Therefore, the nonwoven fabric of the present invention have superior mechanical properties and flexibility.

More preferably, the filaments have a birefringence of $15\times10^{-3}$ to $18\times10^{-3}$, a degree of crystallinity of 17 to 25 wt % and a crystal size of not greater than 75 Å as measured axially of the filaments. The lower limit of the crystal size is about 45 Å. If the crystal size is smaller than the lower limit, the filaments have inferior mechanical properties and, hence, are not suitable for practical use.

The constituent filaments of the non woven fabric have a polymer crystal orientation degree of not lower than 90%.

The polylactic acid based polymers described above may be used either alone or in the form of a blend of two or more polymers selected therefrom. Where a blend of any of the aforesaid polymers is used, the types of polymers to be blended, the blending ratio of the polymers and other blending conditions may be suitably determined in consideration of the spinnability and the like.

As required, various kinds of additives such as a dulling agent, a pigment, a nucleating agent, a flame retarder, a deodorant, an anti-static agent, an anti-oxidant, a UV-absorptive agent, a anti-bacterial agent and a hydrophilic agent may be added to the polymer, as long as the addition does not impair the intended effects of the present invention.

The constituent filaments of the nonwoven fabric may have a circular cross-sectional configuration or any other cross-sectional configuration. Particularly, the filaments are preferably of a hollow cross section, a modified cross section, a sheath-core type composite cross section or a split type composite cross section.

Where the filaments have a hollow cross-sectional configuration, the resulting nonwoven fabric is imparted with an excellent degradability. This is because, as microorganisms and moisture erode the filament from the outer circumferential portion thereof to reach the hollow portion thereof, through-holes are formed in the filament thereby to increase the surface area per unit polymer weight of the filament for enhancement of the microbial degradation rate. Further, the filament of the hollow cross-sectional configuration exhibits an improved quenchability in the spinning process, because the polymer weight of the filament passing through a quenching region in a unit time in the spinning process is relatively small and the filament contains therein an air column of a small specific heat capacity.

Where the filament has a polygonal or planar modified cross-sectional configuration, the filament exhibits an excellent quenchability in the spinning process and an excellent spreadability, and the resulting nonwoven fabric has an improved degradability. This is because the modified cross-sectional filament also has a larger surface area per unit polymer weight.

Where the filament has a sheath-core type composite cross section, it is important that the filament of a sheath-core structure is composed of two filament components including at least one of a polylactic acid based polymer and a blend of plural kinds of polylactic acid based polymers with a core portion thereof being composed of one of the components which has a higher melting point (hereinafter referred to as "higher melting point component") and with a sheath portion thereof being composed of the other component which has a lower melting point (hereinafter referred to as "lower melting point component"). In this case, it is also important that a difference in the melting point between the two components is at least 5° C. or greater, preferably 10° C. or greater, more preferably 20° C. or greater. Thus, a web composed of such filaments can be bonded with heat and pressure at a relatively low temperature close to the melting point of the sheath component without fusing the higher melting point component of the core portion. Therefore, the resulting nonwoven fabric is imparted with an excellent flexibility.

Where the filament has a split type composite cross section, the resulting nonwoven fabric is imparted with an excellent degradability and flexibility. The term "split type composite cross section" herein refers to a filament cross section such that the filament is composed of two filament components including at least one of a polylactic acid based polymer and a blend of plural kinds of polylactic acid based polymers, and comprises plural segments of these two filament components which are splittable from each other and circumferentially arranged and each extend continuously along the length of the filament as being exposed to the exterior of the filament. With this cross sectional configuration, degradation of the filament per se is accelerated by partial degradation of the segments of a more degradable component (usually, the lower melting point component in the case of the polylactic acid based polymer). Therefore, the resulting nonwoven fabric is imparted with an improved degradability. Where the filament of the split type composite cross sectional configuration has a hollow portion therein, the filament has a further improved degradability, quenchability and spreadability. In the process of bonding with heat and pressure, a web composed of filaments of the split type cross sectional configuration can be fusion-bonded at a temperature close to the melting point of the lower melting point component without fusion of the higher melting point component. Therefore, the resulting nonwoven fabric is imparted with an excellent flexibility.

In addition to the filament cross-sectional configurations described above, a circular composite cross-sectional configuration or any of various modified composite cross-sectional configurations such as triangular, quadrangular, hexagonal, planar, Y-shaped, and T-shaped cross-sectional configurations may be employed.

The filament nonwoven fabric of the invention may be constructed such that the web is partially bonded with heat and pressure so as to retain a sheet-like nonwoven structure without individual filaments being joined at their intersections. The nonwoven fabric has an excellent flexibility because the constituent filaments are bonded to each other only in spot fusion-bonded areas partially formed in the web.

The web of the filament nonwoven fabric of the present invention is preliminarily partially bonded with heat and pressure so as to temporarily retain its web structure before the three-dimensional entanglement process. This improves the shape and dimensional stability of the nonwoven fabric. The web is subjected to the three-dimensional entanglement process so that the temporary fusion-bonded spots formed in parts of the web are at least partially or completely de-bonded and the filaments including the de-bonded filament portions are three-dimensionally entangled with each other. Therefore, the resulting nonwoven fabric has a mechanical strength and dimensional stability sufficient for practical use. In addition, the nonwoven fabric has a greater proportion of non-fusion-bonded filament portions thereby to have an excellent flexibility.

The nonwoven fabric of the present invention may be constructed such that at least one surface of the filament web is bonded all over with heat and pressure for retention of a nonwoven structure. The nonwoven fabric has a filmed surface portion and an inner nonwoven portion. The filmed surface portion imparts the nonwoven fabric with air- and water-shielding properties and a superior mechanical strength, while the inner nonwoven portion imparts the nonwoven fabric with a flexibility which is more excellent than an entirely filmed sheet. In addition, the filmed surface portion and the inner nonwoven portion are continuous with no distinct interface therebetween, so that the filament nonwoven fabric of the invention has a higher interlayer peel strength than conventional laminates obtained simply by combining a film with a nonwoven fabric.

The nonwoven fabric of the present invention should have a boiling water shrinkage percentage of not higher than 15%. Only with a boiling water shrinkage percentage of not higher than 15%, the nonwoven fabric is thermally stable for practical use.

The single filament fineness of the constituent filaments of the nonwoven fabric is preferably 1 to 12 denier. If the fineness is smaller than 1 denier, frequent filament breakage occurs in the spinning and drafting process, resulting in a lower operability and a reduction in the strength of the nonwoven fabric. On the other hand, a fineness of greater than 12 denier is not preferred, because the quenchability of the filaments in the spinning process is unsatisfactory and the resulting nonwoven fabric has a poor flexibility.

The nonwoven fabric of the present invention preferably has a tensile strength of not lower than 10 kg/5 cm width per 100 g/m$^2$. The term "tensile strength" used herein means an average of tensile strength values as measured in the machine direction and the cross machine direction in conformity with JIS-L-1096 as will be described later and proportionally converted on a 100 g/m$^2$ basis for evaluation of the nonwoven fabric. If the tensile strength of the nonwoven fabric is lower than 10 kg/5 cm width, the nonwoven fabric lacks for mechanical strength and serves for no practical use.

There will next be described a method of producing the polylactic acid based filament nonwoven fabric in accordance with the present invention.

The nonwoven fabric of the invention can efficiently be produced by the so-called spun-bonded process. More specifically, the polylactic acid based polymer which has a melt flow rate of 10 to 100 g/10 min as measured at a temperature of 210° C. in conformity with ASTM-D-1238 is employed. The polylactic acid based polymer is melt at a spinning temperature in a range from (Tm+20)° C. to (Tm+80)° C. (wherein Tm is the melting point of the polymer), and the resulting melt is extruded into filaments through a spinneret which provides a desired filament cross-sectional configuration. The filaments thus melt-spun are quenched by means of a known quenching device such as of lateral blow type or of annular blow type, and then drafted to a desired fineness by a suction device such as an air sucker in an air stream of 3,000 to 6,500 m/min. A filament mass discharged from the suction device is spread open each other and accumulated on a movable accumulator such as a screen conveyor for formation of a web. Then, the web formed on the movable accumulator is heat-treated to be formed into a nonwoven fabric.

It is important that the polylactic acid based polymer has a melt flow rate (hereinafter referred to as "MFR") of 10 to 100 g/10 min as measured at 210° C. in conformity with the method specified in ASTM-D-1238. If the MFR is smaller than 10 g/10 min, the melt viscosity of the polymer is too high, resulting in a deteriorated high-speed spinnability. On the contrary, if the MFR is greater than 100 g/10 min, the melt viscosity is too low, resulting in a poor stringiness. This makes it difficult to ensure stable operation.

As described above, the melt-spinning should be carried out at a temperature in the range of (Tm+20)° C. to (Tm+80)° C. (wherein Tm is the melting point of the polymer). It is noted that, where a blend of two or more kinds of polylactic acid based polymers is employed, the highest one of the melting points of the constituent polymers of the blend is regarded as Tm° C. If the spinning temperature is lower than (Tm+20)° C., the stringiness and draftability in the high-speed air stream are reduced. On the other hand, if the spinning temperature is higher than (Tm+80)° C., the crystallization of the polymer in the quenching process is retarded, so that inter-filament adhesion and a poor filament spreadability may result. In addition, thermal decomposition of the polymer per se may proceed. Therefore, it is difficult to provide a flexible nonwoven fabric having a uniform texture.

When the spun filaments are drafted by means of the suction device, it is important to adjust the drafting speed at 3,000 to 6,500 m/min as previously described. The drafting speed may properly be selected according to the MFR of the polymer. With the drafting speed set at a level in the aforesaid range, the nonwoven fabric having the structural properties intended by the invention can be obtained. More specifically, the molecular orientation and crystallization of the polymer are promoted by applying a spinning stress to the polymer by the high-speed drafting. Further, the polymer orientation predominantly proceeds in crystalline regions to allow polymer crystals to grow axially of the filament, while the orientation of polymer molecules does not sufficiently proceed in amorphous regions.

If the drafting speed or the spinning rate is lower than 3,000 m/min, the molecular orientation is not sufficient to impart the nonwoven fabric with a practically acceptable strength and, hence, the nonwoven fabric has a higher residual extensibility. Therefore, the nonwoven fabric composed of the filaments having a lower orientation degree and a lower crystallinity is inferior in dimensional stability and mechanical properties. Further, the nonwoven fabric has a lower stability and, therefore, is liable to be shrunk when used in a high temperature environment. The lower speed spinning process may provide filaments which can be press-bonded at a relatively low temperature in the process of partially bonding with heat and pressure. For example, the process of boding with heat and pressure can be performed at a temperature lower by at least 50° C. than the melting point of the constituent polymer of the filaments. However, the filaments are thermally unstable, so that filaments around web portions to be bonded with heat and pressure in contact with projections of an embossing roll may also be affected by the heat during the process of partially bonding with heat and pressure. Therefore, the resulting nonwoven fabric is stiff and inferior in flexibility. This is because the filaments obtained by the drafting at a drafting speed of lower than 3,000 m/min have an excessively low birefringence and crystallinity or contain a greater proportion of amorphous regions, and are liable to be deformed or shrunk when subjected to heat.

On the other hand, filaments for the nonwoven fabric obtained by the drafting at a drafting speed of not lower than 3,000 m/min in accordance with the present invention are thermally stable, because the molecular orientation has proceeded due to the high-speed spinning stress and crystals have grown to be oriented in crystalline regions. If the filaments obtained through the lower-speed spinning process are subjected to the process of partially bonding with heat and pressure at a temperature lower by at least 50° C. than the melting point of the constituent polymer of the filaments, the bonding of the web with heat and pressure is insufficient, so that the resulting nonwoven fabric has poor mechanical properties. Therefore, the process of bonding with heat and pressure is preferably performed at a temperature lower than the melting point (Tm° C.) of the constituent polymer of the filaments, particularly at a temperature in a range between (Tm−35)° C. and Tm° C. In the nonwoven fabric subjected to the process of partially bonding with heat and pressure according to the present invention, filaments in portions of the nonwoven fabric bonded with heat and pressure in contact with the projections of the embossing roll have been thermally affected, but filaments around the portions bonded with heat and pressure have not been thermally affected. Therefore, the nonwoven fabric is superior in flexibility and mechanical properties.

On the contrary, if the drafting speed is greater than 6,500 m/min, the resulting filaments have less even diameters. Although the crystallinity of the constituent polymer of the filaments is enhanced, the spinning stress is increased to cause strains in the filaments. This disturbs the crystalline structure of the polymer, so that micro-voids are liable to occur in the crystalline structure. Therefore, the resulting filaments are not suitable for practical use. Further, the filaments and nonwoven fabric are inferior in mechanical strength.

For the heat treatment of the web, the process of partially bonding with heat and pressure is performed at a temperature lower than the lowest one of the melting points of the constituents polymers of the filaments. In the process of partially bonding with heat and pressure, spot fusion-bonded areas are formed in the web through an embossing process or an ultrasonic fusion bonding process. Specifically, the web is passed between a heated embossing roll and a smooth surface metal roll for the formation of the spot fusion-bonded areas on the filaments in the web.

More specifically, fusion-bonded spots which are formed in specific parts of the web preferably each have a circular, oval, rhombic, triangular, T-shaped or #-shaped configuration with an area of 0.2 to 15mm$^2$, and the distribution density of the spots or a fusion-bonded spot density is preferably 4 to 100 spots/cm$^2$. If the fusion-bonded spot density is lower than 4 spots/cm$^2$, no improvement is achieved in the mechanical strength and shape retaining property of the nonwoven fabric. On the contrary, if the fusion-bonded spot density is higher than 100 spots/cm$^2$, the resulting nonwoven fabric is liable to be less flexible because of its coarseness and stiffness. Therefore, a fusion-bonded spot density out of the aforesaid range is not preferred. The ratio of the total area of the fusion-bonded spots to the entire web area or a fusion area percentage is preferably 3 to 50%. If the fusion area percentage is less than 3%, it is impossible to improve the mechanical strength and shape retaining property of the nonwoven fabric. On the contrary, if the fusion area percentage is greater than 50%, the resulting nonwoven fabric is liable to be less flexible because of its coarseness and stiffness.

The working temperature for the bonding with heat and pressure, i.e., the surface temperature of the embossing roll, should be lower than the melting point of the polymer employed for the filaments. However, where the web to be subjected to the process of bonding with heat and pressure is composed of filaments of a blend of two or more kinds of polylactic acid based polymers, or where the web is composed of bicomponent filaments having a composite cross-sectional configuration, e.g., a sheath-core type composite cross section or a split type composite cross section as mentioned earlier, determination of the working temperature is based on the lowest one of the melting points of the constituent polymers of the blend or on the lower one of the melting points of the two polymer components of the composite filaments. If the working temperature is higher than the melting point of the polymer, the resulting nonwoven fabric is less flexible with a stiff texture. In addition, the polymer is liable to adhere onto an apparatus for bonding with heat and pessure, thereby considerably reducing the operability.

Instead of the embossing roll process, the ultrasonic fusion bonding process may be employed for the process of bonding with heat and pressure, in which ultrasonic waves of high frequency are applied to the web on a pattern roll by means of a ultrasonic fusion apparatus for formation of the spot fusion areas on filaments in pattern portions. More specifically, the ultrasonic fusion apparatus comprises an ultrasonic oscillator with an oscillation frequency of 20 kHz called "horn", and a pattern roll having projections of dot or band shape arranged circumferentially thereon. The pattern roll is disposed below the ultrasonic oscillator so that the web is passed through a clearance between the ultrasonic oscillator and the pattern roll for the partial fusion. The projections may be arranged in a row or a plurality of rows on the pattern roll. The plural rows of projections may be arranged in a parallel or staggered relation.

The process of partially bonding with heat and pressure employing the embossing roll or the ultrasonic fusion apparatus may be performed as part of a continuous process or as a separate process. Which process is to be employed may be determined in accordance with the end use of the nonwoven fabric.

Next, an explanation will be given to a production method for the nonwoven fabric of the present invention which has a construction such as obtained by preliminarily forming temporary fusion-bonded spots in parts of the web, and subjecting the web to the three-dimensional entanglement process to partially or completely de-bond the temporary fusion-bonded spots and to three-dimensionally entangle non-fusion-bonded portions of the filaments for integration of the filaments.

In this case, the web formed on the movable accumulator in the aforesaid manner is partially bonded with heat and pressure at a working temperature of (Tm−80)° C. to (Tm−50)° C. (wherein Tm is the lowest one of the melting points of the polymer components of the constituent filaments of the web) at a roll linear pressure of 5 to 30 kg/cm by means of an apparatus for partially bonding with heat and pressure for formation of the temporary fusion-bonded spots in the web. Then, the resulting web is subjected to the three-dimensional entanglement process so as to de-bond at least some of the temporary fusion-bonded spots of the constituent filaments and to three-dimensionally and entirely entangle the filaments including the de-bonded filament portions for integration thereof. Thus, the filament nonwoven fabric can be obtained.

In this way, the preliminary partial bonding with heat and pressure allows for tentative shape retention of the web, so that the web has an improved shape retention property and mechanical strength which ensure easy handling of the web in the three-dimensional entanglement process to be thereafter performed. Since at least some of the temporary fusion-bonded spots are de-bonded through the three-dimensional entanglement process, the nonwoven fabric finally obtained has a greater proportion of non-fusion-bonded filament portions thereby to have an excellent flexibility. Where the temporary fusion-bonded spots are completely de-bonded through the three-dimensional entanglement process, the resulting nonwoven fabric is imparted with a superior flexibility, while maintaining its nonwoven structure. On the other hand, where the temporary fusion-bonded spots are not completely de-bonded but some of the fusion-bonded spots remain, the dimensional stability and mechanical strength of the nonwoven fabric can be ensured by the three-dimensional entanglement of the constituent filaments including the de-bonded filament portions, and further enhanced by the remaining fusion-bonded spots.

The fusion-bonded spots preliminarily formed in parts of the web each have an area of 0.2 to 15 $mm^2$, and the density of the fusion-bonded spots is 4 to 100 spots/$cm^2$, preferably 5 to 80 spots/$cm^2$. If the density of the fusion-bonded spots is lower than 4 spots/$cm^2$, no improvement is achieved in the mechanical strength and shape retaining property of the web after the process of bonding with heat and pressure. On the contrary, if the density of the fusion-bonded spots is higher than 100 spots/$cm^2$, the workability of the web in the three-dimensional entanglement process is deteriorated. The fusion-bonded are a percentage is preferably 3 to 50%, more preferably 4 to 40%. If the fusion-bonded area percentage is less than 3%, it is impossible to improve the dimensional stability of the nonwoven fabric. On the contrary, if the fusion-bonded area percentage is greater than 50%, the workability of the web in the three-dimensional entanglement process is reduced.

The aforesaid requirements for the working temperature and the roll linear pressure in the process of bonding with heat and pressure are particularly important. If the working temperature is lower than (Tm−80)° C. and/or if the roll linear pressure is lower than 5 kg/cm, the process of bonding with heat and pressure offers a poor effect, so that no improvement is achieved in the shape retaining property and mechanical strength of the nonwoven fabric. On the contrary, if the working temperature is higher than (Tm−50)° C. and/or if the roll linear pressure is higher than 30 kg/cm, the effect offered by the process of bonding with heat and pressure is excessive, making it difficult to partially de-bond the fusion-bonded spots in the three-dimensional entanglement process. Therefore, the three-dimensional entanglement of the non-fusion-bonded filament portions cannot sufficiently be effected, making it difficult to integrate the filaments into the nonwoven structure.

The requirements thus specified for the working temperature and the roll linear pressure make it possible to preliminarily and partially form temporary fusion-bonded spots at contacts between the constituent filaments of the filament web. These partial temporary fusion-bonded spots improve the shape retaining property and mechanical strength of the web after the process of bonding with heat and pressure, and ensures easy handling of the web in the three-dimensional entanglement process to be thereafter performed. Further, the fusion-bonded spots each have a bonding strength such that at least some of the fusion-bonded spots can easily be de-bonded by an external mechanical force applied thereto during the three-dimensional entanglement process.

The three-dimensional entanglement process to be performed after the process of partially bonding with heat and pressure is achieved by a needle punching process or a pressurized liquid stream treatment process in which pressurized liquid streams are applied to the web.

Where the pressurized liquid stream treatment process is to be employed for the three-dimensional entanglement, the web produced by the spun bonding process and partially formed with the temporary fusion-bonded spots is placed on a moving perforated support plate, and is exposed to pressurized liquid streams, whereby the filaments including the partially de-bonded filament portions are three-dimensionally entangled with each other for integration thereof.

To generate pressurized liquid streams, an apparatus is employed which includes an orifice head having a multiplicity of ejection orifices arranged at an interval of 0.3 to 10 mm in a row or plural rows, the ejection orifices each having an orifice diameter of 0.05 to 2.0 mm, preferably 0.1 to 0.4 mm. The apparatus ejects the pressurized liquid at an ejection pressure of 5 to 150 kg $cm^2G$. If the pressure of the liquid streams is lower than 5 kg/$cm^2G$, it is difficult to partially de-bond the fusion-bonded spots, failing to sufficiently three-dimensionally entangle the constituent filaments with each other. On the contrary, if the pressure of the liquid streams is higher than 150 kg/$cm^2G$, the filaments are so densely entangled that the resulting nonwoven fabric tends to be less flexible. The ejection orifices are arranged in a row or plural rows perpendicularly to a web advancing direction. Where a plurality of rows of ejection orifices are provided, the ejection orifices are preferably arranged in a staggered relation for uniformly applying the pressurized liquid streams onto the web. Further, the apparatus may include a plurality of orifice heads each having ejection orifices. For the pressurized liquid stream treatment, it is common to use fresh water or warm water as the pressurized liquid. A distance between the ejection orifices and the web is preferably 1 to 15 cm. If the distance is less than 1 cm, the resulting nonwoven fabric has an irregular texture. On the contrary, if the distance is greater than 15 cm, the impact force of liquid streams exerted on the web is too small to ensure sufficient three-dimensional entanglement. The support base to be employed for supporting the web in the pressurized liquid stream treatment process is, for example, a mesh screen such as 15- to 100-mesh wire net or a perforated plate, but not limited thereto as long as the pressurized liquid streams can penetrate through the web.

Filaments on both sides of the web may tightly be integrated by subjecting one side of the web to the aforesaid entanglement process, then turning over the web, and subjecting the other side of the web to the entanglement process in the same manner by supplying pressured liquid streams. Thus, the resulting nonwoven fabric has an excellent dimensional stability and mechanical strength.

After the pressurized liquid stream treatment process, excess water should be removed from the treated web. The removal of the excess water can be achieved by any know method. For example, the excess water is mechanically removed to some extent by means of a squeezing device such as a mangle roll, and residual water is removed by means of a dryer such as a continuous hot air drier. The drying process may employ an ordinary dry heat treatment or, alternatively, a wet heat treatment as required. The treatment conditions such as treatment temperature and treatment time for the drying process may properly be determined not only for the water removal but also for impartation of moderate shrinkage to the nonwoven web.

Where the needle punching process is employed for the three-dimensional entanglement, the web produced by the spun bonding process and partially formed with the temporary fusion-bonded spots is punched through by punch needles, so that the filaments including at least partially de-bonded filament portions are three-dimensionally entangled with each other for integration thereof.

The needle punching process is preferably carried out under the conditions of a needle depth of 5 to 50 mm and a punching density of 50 to 400 punches/cm$^2$. If the needle depth is less than 5 mm, the entanglement degree of the filaments is small, resulting in a poor dimensional stability. A needle depth of more than 50 mm poses a problem associated with the productivity. If the punching density is smaller than 50 punches/cm$^2$, it is impossible to ensure smooth de-bonding of the temporary fusion-bonded spots of the constituent filaments and sufficient entanglement of the filaments, so that the resulting nonwoven fabric tends to have a poor dimensional stability. On the contrary, if the punching density is greater than 400 punches/cm$^2$, the filaments are cut by the punch needles, so that the resulting nonwoven fabric may have a reduced mechanical strength. The thickness, length, number of barbs, barb pattern and the like of each punch needle are properly selected according to the single filament fineness, intended use of the nonwoven fabric and the like.

The pressurized liquid stream treatment process described above provides for a nonwoven fabric superior in flexibility and mechanical strength, which is applicable to a product having a relatively low weight per unit area (15 to 100 g/m$^2$). The needle punching process provides for a nonwoven fabric superior in flexibility, air permeability and water permeability, which is applicable to a product having a relatively high weight per unit area (100 to 500 g/m$^2$). The selection of an applicable process is based on the weight per unit area because of a difference in the web penetrating ability between the pressurized liquid streams and the needle punches. Where the pressurized liquid stream treatment process is applied to a web of a high weight per unit area, for example, pressurized liquid streams do not penetrate through the thickness of the web, so that the uniform three-dimensional entanglement cannot be effected over the entire web but only in the surface layer of the web. Therefore, it is desirable that the selection of the applicable process is based on the weight per unit area of the nonwoven fabric and the end use of the nonwoven fabric.

With this arrangement, fusion-bonded spots that have not been de-bonded through the three-dimensional entanglement process but remain intact in the spot fusion-bonded areas are present at a density of not greater than 20 spots/cm$^2$, preferably not greater than 10 spots/cm$^2$, with a fusion-bonded area percentage of not greater than 15%, preferably not greater than 10%. The constituent filaments in the filament nonwoven fabric having such spot fusion-bonded areas are efficiently entangled with each other through the three-dimensional entanglement process due to the presence of non-fusion-bonded filament portions. Thus, the nonwoven fabric exhibits an excellent dimensional stability and mechanical strength. Where the spot fusion-bonded areas partially remain in the web, the remaining spot fusion-bonded areas enhance the dimensional stability and mechanical strength of the nonwoven fabric. Since the temporary fusion-bonded spots are partially or completely de-bonded through the three-dimensional entanglement process as described above, the resulting nonwoven fabric has a greater proportion of non-fusion-bonded filament portions, exhibiting an excellent flexibility. At the same time, the nonwoven fabric is imparted with dimensional stability and mechanical strength by the three-dimensional entanglement of the non-fusion-bonded filament portions.

An explanation will next be given to a method of producing a nonwoven fabric according to the present invention, wherein the nonwoven fabric is obtained by bonding with heat and pressure at least one surface of a filament web all over.

Prior to the process of bonding with heat and pressure at least one surface of a filament web all over, a web formed on a movable accumulator may be subjected to the temporary process of partially bonding with heat and pressure, as required. After the temporary process of boding with heat and pressure, the web may be subjected to the three-dimensional entanglement process for enhancement of the bulkiness of the web. Where the web continuously formed by the spun bonding process is tentatively wound, these processes prevent inter-web entanglement which otherwise makes it difficult to unwind the web. Therefore, the temporary process of partially bonding with heat and pressure to be performed for this purpose is merely required to impart the web with a tentative shape retaining ability for prevention of the inter-web entanglement at the web winding.

The process of bonding with heat and pressure at least one surface of a filament web all over is achieved by fusing the filaments in the surface and sub-surface portions of the web by means of a heated metal roll having a smooth surface for filming the web surface.

The working temperature for the process of bonding with heat and pressure at least one surface of a filament web all over, i.e., the surface temperature of the metal roll should be a temperature not higher than (Tm−10)° C. (wherein Tm is the melting point of the polymer used) as described above. However, where the web to be subjected to this process is composed of filaments of a blend of two or more kinds of polylactic acid based polymers, or where the web is composed of bicomponent filaments having a composite cross-sectional configuration, e.g., a sheath-core type composite cross section or a split type composite cross section as mentioned earlier, the determination of the working temperature is based on the highest one of the melting points of the constituent polymers of the blend or on the higher one of the melting points of the two polymer components of the composite filaments. If the working temperature is higher than the aforesaid temperature, the polymer adheres onto the apparatus for bonding with heat and pressure, thereby reducing the operability. In addition, the resulting nonwoven fabric has an unsatisfactory texture because of its coarseness and stiffness.

In the process of bonding with heat and pressure at least one surface of a filament web all over, it is important to adjust the roll linear pressure at not lower than 0.01 kg/cm. If the roll linear pressure is lower than 0.01 kg/cm, the process of bonding with heat and pressure offers a poor effect, making it impossible to improve the mechanical strength and dimensional stability of the nonwoven fabric. On the other hand, if the roll linear pressure is higher than 10 kg/cm, the effect offered by the process of bonding with heat and pressure is excessive, so that the nonwoven fabric tends to be entirely filmed to have a coarse and stiff texture. Therefore, the roll linear pressure is preferably not higher than 10 kg/cm.

In the present invention, it is merely necessary to subject at least one surface of the web to the process of bonding with heat and pressure. Particularly where both surfaces of the web are subjected to the process, the resulting nonwoven fabric has a three-layer structure which consists of air- and water-impermeable film surface layers provided on its both surfaces and a air-containing nonwoven layer provided therebetween. Thus, the nonwoven fabric has a superior heat retaining property.

The process of bonding with heat and pressure at least one surface of a filament web all over may be performed as part of a continuous process or as a separate process.

EXAMPLES

The present invention will hereinafter be explained more specifically by way of the following examples. It is understood that the invention is in no way limited to these examples.

In the following examples and comparative examples, various physical property values were determined as stated below.

(1) MFR (g/10 min): The MFR was measured at 210° C. in accordance with the method specified in ASTM-D-1238.

(2) Melting Point (° C.): An exothermic-endothermic curve was prepared on the basis of measurements obtained with a sample weight of 5 mg at a temperature rise rate of 20° C./min by means of a differential scanning calorimeter Model DSC-2 available from Perkin Elmer. In the exothermic-endotherm curve, an endothermic peak temperature was defined as a melting point Tm (° C.).

(3) Birefringence: The birefringence was measured with the use of tricresyl phosphate as an immersion liquid by means of a polarizing microscope equipped with a Berek compensator.

(4) Degree of Crystallity (wt %): A filament sample was powdered and filled in an Al sample holder (20×18×0.5 mm). The sample holder was vertically held, and a Cu-K α-ray generated by means of a RAD-rB type X-ray generator available from Rigaku Denki Co., Ltd. was directed toward the sample perpendicularly thereto. A curved graphite monochromater was used as a light receiving device. The scan was made on the sample in a range of 2θ=5 to 125°, and the crystallization degree was determined from the measurements on a weight percentage basis through the Ruland method.

(5) Crystal Size as Measured Axially of Filaments: The crystal size was measured by a symmetrical transmission method by means of an X-ray generating apparatus Model $MXP^3$ available from Max Science Co. More specifically, a sample of unidirectionally aligned and bundled filaments was held vertically, and a Cu-K α-ray filtered by an Ni filter was directed toward the sample perpendicularly thereto. A diffraction intensity was measured with respect to a plane reflection which provided the highest intensity among the reflections along the axes of the filaments (c-axis). On the basis of the width B (radian) at half height of the diffraction peak, the crystal size Dhkl was determined from the following Scherrer equation.

$$Dhkl=K\cdot\lambda/\beta\cos\theta$$

$$(\beta=(B^2-b^2)^{1/2})$$

wherein K is a constant (K=0.9), λ is the wavelength of the X-ray (λ=0.15418 nm), θ is a Bragg angle, and b is a constant unique to the apparatus (Bcal=2.684/1000×2θ+0.9972).

(6) Degree of Crystal orientation: An azimuthal angle was determined with respect to a diffraction peak observed at 20=16.180 of the (200) plane reflection at equator scanning. The crystal orientation degree f was determined from the following simple equation on the basis of the width H at half height of the diffraction peak.

$$f=100(180-H)/180$$

(7) Filament Breakage Resistance: A spun filament which was free from breakage for 10 hours when drafted by means of an air sucker was regarded acceptable, and indicated by "o" in the following tables. A spun filament which suffered from breakage in 10 hours was regarded unacceptable, and indicated by "x" in the tables.

(8) Weight ($g/m^2$): Ten specimens of 10 cm×10 cm (length×width) were prepared from a sample in standard conditions. The specimens, after being allowed to reach an equilibrium moisture regain, were each weighed in a unit of gram. The weight values thus obtained were averaged, and converted on the basis of unit area for determination of the weight ($g/m^2$) of a nonwoven fabric.

(9) KGSM Tensile Strength (kg/5 cm width): The KGSM tensile strength was measured in accordance with the strip method specified in JIS-L-1096. More specifically, ten specimens of 20 cm×5 cm (length×width) were prepared. The specimens were each stretched, by being clamped at positions 10 cm distanced from each other, in the machine direction and cross-machine direction of a nonwoven fabric at a stretching rate of 20 cm/min by means of a tensile tester of constant rate stretching type (available under the trade name of Tensilon UTM-4-1-100 from Toyo Baldwin Company). Obtained breakage load values (kg/5 cm width) were averaged, and converted on the basis of weight (100 $g/m^2$) for determination of the KGSM strength (kg/5 cm width).

(10) Compressive resilience (g, $g/(g/m^2)$): Five specimens of 10 cm×5 cm (length×width) were prepared, each of which was then rolled into a cylindrical form having a height of 5 cm with opposite ends thereof bonded to each other, in order for preparation of test samples for the compressive resilience test. In turn, the test samples were each axially compressed at a compression rate of 5 cm/min by means of a tensile tester of constant rate stretching type (available under the trade name of Tensilon UTM-4-1-100 from Toyo Baldwin Company). Obtained peak load values (g) were averaged for determination of the compressive resilience. Further, the compressive resilience ($g/(g/m^2)$) on the basis of weight per unit (100 $g/m^2$) was calculated. The smaller the compressive resilience, the more excellent the flexibility of a nonwoven fabric.

(11) Biodegradability: A sample of a nonwoven fabric was buried in an aged compost maintained at about 58° C. and taken out three months later. Where the nonwoven fabric sample did not have its original shape or, even if having its original shape, its tensile strength was lowered to not higher than 50% of its initial strength observed before the burial, the biodegradability of the nonwoven fabric sample was regarded acceptable, and indicated by "o" in the following tables. Where the tensile strength was higher than 50% of the initial strength observed before the burial, the biodegradability was regarded unacceptable, and indicated by "x" in the tables.

(12) Boiling Water Shrinkage Percentage (%): A specimen of 20 cm×20 cm was immersed in boiling water for 15 minutes, and then the area ($Xcm^2$) of the specimen was measured. The boiling water shrinkage percentage (%) was calculated from the following equation.

$$\text{Boiling water shrinkage percentage}=(400-X)\times 100/400$$

(13) Air Permeability ($cc/cm^2$ sec): The air permeability was measured in accordance with the Frazir method specified in JIS-L-1096A. More specifically, five specimens of 20×20 cm were prepared from a sample, and a Frazir type tester (APS-360 available from Daiei Kagaku Seiki Co., Ltd.) was employed for the measurement. The specimens were each fitted on one end of a cylinder of the tester, and a suction pump was regulated so that a tilting type barometer gave a pressure reading of 1.27 cm water column. The amount of air passing through the specimen was determined on the basis of a pressure reading of a vertical barometer and the type of an air orifice used with reference to a table appended to the tester. Obtained air amount values were averaged for determination of the air permeability ($cc/cm^2$ sec).

EXAMPLE 1

A copolymer of L-lactic acid and D-lactic acid (L-lactic acid/D-lactic acid=99/1 mol %) having a melting point of 171° C. and an MFR of 40 g/10 min was employed. The copolymer was melt-spun into filaments through a circular spinneret at a spinning temperature of 200° C. at a mass out flow rate from each orifice of 1.00 g/min. The spun filaments were quenched by quench air streams, and then drafted at 3,000 m/min by an air sucker. The filaments were spread open each other and accumulated on a collector surface of a traveling conveyor thereby to be formed into a web. The web was then passed through an apparatus for partially bonding with heat and pressure which comprises embossing rolls so as to be partially bonded with heat and pressure under the following conditions: a roll temperature of 140° C.; a fusion-bonded area percentage of 14.9%; a fusion-bonded spot density of 21.9 spots/$cm^2$; and a linear pressure of 30 kg/cm. Thus, a filament nonwoven fabric comprised of filaments of 3.0 denier in single filament fineness and having a weight of 20 g/$m^2$ was obtained. The physical properties of the filaments, the production conditions, the operability, and the physical properties and biodegradability of the nonwoven fabric are shown in Table 1.

When the crystal size was determined, the highest intensity reflection among the reflections along the axes of the filaments (c-axis) was observed on the (0010) plane. A diffraction peak was observed at 31.50 (diffraction angle: 2θ) which was employed for determination of the crystal size.

TABLE 1

| | Ex. 1 | Ex. 2 | Ex. 3 | Ex. 4 | Ex. 5 |
|---|---|---|---|---|---|
| Physical properties of filaments | | | | | |
| Molar ratio L/D | 99/1 | 99/1 | 99/1 | 99/1 | 99/1 |
| Tm (° C.) | 171 | 171 | 171 | 171 | 171 |
| MFR (g/10 min) | 40 | 40 | 40 | 40 | 40 |
| Birefringence ($\times 10^{-2}$) | 12.0 | 14.2 | 17.0 | 18.4 | 19.9 |
| Degree of crystallinity (wt %) | 13.4 | 18.2 | 21.0 | 23.9 | 25.3 |
| Crystal size (Å) | 45 | 64 | 71 | 74 | 78 |
| Crystal orientation degree (%) | 93.3 | 94.6 | 95.4 | 95.8 | 96.0 |
| Production conditions for nonwoven fabric | | | | | |
| Filament sectional configuration | *1 | *1 | *1 | *1 | *1 |
| Spinning temperature (° C.) | 200 | 200 | 200 | 200 | 200 |
| Mass out flow rate from each orifice (g/min) | 1.00 | 1.33 | 1.67 | 1.83 | 2.00 |
| Drafting speed (m/min) | 3000 | 4000 | 5000 | 5500 | 6000 |
| Press temperature (° C.) | 140 | 141 | 143 | 144 | 145 |
| Operability | | | | | |
| Filament breakage resistance | ○ | ○ | ○ | ○ | ○ |
| Physical properties of nonwoven fabric | | | | | |
| Single filament fineness (d) | 3.0 | 3.0 | 3.0 | 3.0 | 3.0 |
| Weight (g/$m^2$) | 20 | 20 | 20 | 20 | 20 |
| Tensile strength (kg/5 cm width) | 15 | 17 | 20 | 23 | 27 |
| Compressive resilience (g) | 19 | 18 | 16 | 15 | 15 |
| Shrinkage percentage (%) | 10.0 | 6.3 | 4.7 | 4.5 | 4.1 |
| Biodegradability | ○ | ○ | ○ | ○ | ○ |

*1: Monocomponent circular sectional configuration

TABLE 2

| | Ex. 6 | Ex. 7 | Ex. 8 | Ex. 9 |
|---|---|---|---|---|
| Physical properties of filaments | | | | |
| Molar ratio L/D | 99/1 | 99/1 | 99/1 | 92/8,99/1 |
| Tm (° C.) | 171 | 171 | 171 | 140,171 |
| MFR (g/10 min) | 40 | 40 | 40 | 30,40 |
| Birefringence ($\times 10^{-3}$) | 17.2 | 13.8 | — | — |
| Degree of crystallinity (wt %) | 23.1 | 18.5 | 23.5 | 18.8 |
| Crystal size (Å) | 73 | 72 | 76 | 71 |
| Crystal orientation degree (%) | 95.6 | 95.3 | — | — |
| Production conditions for nonwoven fabric | | | | |
| Filament sectional configuration | *1 | *1 | *2 | *3 |
| Spinning temperature (° C.) | 200 | 200 | 200 | 200 |
| Mass out flow rate from each orifice (g/min) | 0.83 | 4.67 | 1.83 | 1.83 |
| Drafting speed (m/min) | 5000 | 6000 | 5500 | 5500 |
| Press temperature (° C.) | 144 | 143 | 144 | 115 |
| Operability | | | | |
| Filament breakage resistance | ○ | ○ | ○ | ○ |
| Physical properties of nonwoven fabric | | | | |
| Single filament fineness (d) | 1.5 | 7.0 | 3.0 | 3.0 |
| Weight (g/$m^2$) | 20 | 20 | 20 | 20 |
| Tensile strength (kg/5 cm width) | 21 | 25 | 22 | 23 |
| Compressive resilience (g) | 11 | 18 | 13 | 13 |

TABLE 2-continued

| | Ex. 6 | Ex. 7 | Ex. 8 | Ex. 9 |
|---|---|---|---|---|
| Shrinkage percentage (%) | 4.0 | 4.6 | 4.1 | 4.8 |
| Biodegradability | ○ | ○ | ○ | ○ |

*1: Monocomponent circular sectional configuration
*2: Monocomponent triangular sectional configuration
*3: Sheath-core type composite sectional configuration

EXAMPLES 2 to 7

Filament nonwoven fabrics according to Examples 2 to 7 were each produced in substantially the same manner as in Example 1, except the the mass out flow rate from each orifice, the drafting speed, the press temperature and the single filament fineness were as shown in Tables 1 and 2. The physical properties of the filaments, the production conditions, the operability and the physical properties and biodegradability of the nonwoven fabrics are also shown in Tables 1 and 2.

EXAMPLE 8

A nonwoven fabric according to Example 8 was prepared in substantially the same manner as in Example 4, except that the filament cross section was triangular. The physical properties of filaments, the production conditions, the operability and the physical properties and biodegradability of the nonwoven fabrics are also shown in Table 2.

EXAMPLE 9

A copolymer of L-lactic acid and D-lactic acid (L-lactic acid/D-lactic acid=92/8 mol %) having a melting point of 140° C. and an MFR value of 30 g/10 min and a copolymer of L-lactic acid and D-lactic acid (L-lactic acid/D-lactic acid=99/1 mol %) having a melting point of 171° C. and an MFR of 40 g/10 min were employed as a first polymer component and a second polymer component, respectively, and the first and second polymer components were used in a weight ratio of 1:1. The polymer components were melt-spun into filaments at a spinning temperature of 200° C. at a mass out flow rate from each orifice of 1.83 g/min through a spinneret which was capable of forming a sheath-core type composite sectional configuration with their core portions composed of the first polymer component and with their sheath portions composed of the second polymer component. The spun filaments were quenched by quench air streams, and then drafted at 5,5000 m/min by an air sucker. The filaments were spread open each other and accumulated on a collector surface of a traveling conveyor thereby to be formed into a web. The web was then passed through an apparatus for partially bonding with heat and pressure which comprises embossing rolls so as to be partially bonded with heat and pressure under the following conditions: a roll temperature of 115° C.; a fusion-bonded area percentage of 14.9%; a fusion-bonded spot density of 21.9 spots/cm$^2$; and a linear pressure of 30 kg/cm. Thus, a filament nonwoven fabric comprised of filaments of 3.0 denier in single filament fineness and having a weight of 20 g/m$^2$ was obtained. The physical properties of the filaments, the production conditions, the operability, and the physical properties and biodegradability of the nonwoven fabric are shown in Table 2.

As apparent from Tables 1 and 2, the filament nonwoven fabrics of Examples 1 to 9 each had a birefringence of $10\times10^{-3}$ to $25\times10^{-3}$, thereby being excellent in mechanical properties such as strength. Since the filaments were spun at a high speed, the filaments had a higher degree of crystallinity which fell within the range specified in the present invention. In addition, the filaments contained a greater proportion of amorphous regions (or regions containing polymer molecules having a higher degree of freedom) and, hence, the nonwoven fabrics each have a lower value of compressive resilience and an excellent flexibility. The nonwoven fabrics each had a boiling water shrinkage percentage which fell within the range specified in the present invention and, therefore, were suitable for practical use and stable to heat. Further, the nonwoven fabrics were superior in biodegradability. This was proved by the fact that the nonwoven fabrics each had a great weight reduction rate and experienced a great shape change and a remarkable reduction in strength after being buried in the compost for a predetermined period.

COMPARATIVE EXAMPLES 1 to 3

Nonwoven fabrics were produced in substantially the same manner as in Example 1, except that the mass out flow rate from each orifice, the drafting speed and the press temperature were as shown in Table 3. The physical properties of the filaments, the production conditions, the operability and the physical properties and biodegradability of the nonwoven fabrics are also shown in Table 3.

TABLE 3

| | Com. Ex. 1 | Com. Ex. 2 | Com. Ex. 3 | Com. Ex. 4 Undrawn | Com. Ex. 4 Drawn |
|---|---|---|---|---|---|
| Physical properties of filaments | | | | | |
| Molar ratio L/D | 99/1 | 99/1 | 99/1 | 99/1 | — |
| Tm (° C.) | 171 | 171 | 171 | 171 | — |
| MFR (g/10 min) | 40 | 40 | 40 | 40 | — |
| Rirefringence ($\times10^{-3}$) | 8.4 | 20.9 | — | 6.2 | 34 |
| Crystallization degree (wt %) | 9.1 | 25.0 | — | 8.7 | 31.2 |
| Crystal size (Å) | 15.5 | 81 | — | 14.2 | 90 |
| Crystal orientation degree (%) | 63.1 | 96.4 | — | 61.8 | 97.0 |
| Production conditions for nonwoven fabric | | | | | |
| Filament sectional configuration | *1 | *1 | *1 | *1 | *1 |
| Spinning temperature (° C.) | 200 | 200 | 200 | 200 | — |
| Mass out flow rate from each orifice g/min) | 0.33 | 2.33 | 1.83 | 0.82 | — |
| Drafting speed (m/min) | 1000 | 7500 | 5500 | 1000 | — |
| Press temperature (° C.) | 120 | 147 | 175 | — | 149 |
| Draw ratio | — | — | — | — | 2.6 |
| Operability | | | | | |
| Filament breakage resistance | ○ | x | ○ | ○ | — |
| Physical properties of nonwoven fabric | | | | | |
| Single filament fineness (d) | 3.0 | 3.0 | 3.0 | — | 3.0 |
| Weight (g/m$^2$) | 20 | 20 | 20 | — | 20 |
| Tensile strength (kg/5 cm width) | 12 | 16 | — | — | 29 |
| Compressive resilience (g) | 405 | 15 | — | — | 52 |

TABLE 3-continued

| | Com. Ex. 1 | Com. Ex. 2 | Com. Ex. 3 | Com. Ex. 4 Undrawn | Com. Ex. 4 Drawn |
|---|---|---|---|---|---|
| Shrinkage percentage (%) | 43.5 | 3.8 | — | — | 2.6 |
| Biodegradability | ○ | ○ | — | — | ○ |

*1: Monocomponent circular sectional configuration

As apparent from Table 3, the nonwoven fabric of Comparative Example 1 had a lower molecular orientation degree, a birefringence of $8.4\times10^{-3}$ which was lower than the lower limit ($10\times10^{-3}$) specified in the invention, a degree of crystallinity of 9.1% which was lower than the lower limit (12%) specified in the invention, because the drafting speed was low. Therefore, the nonwoven fabric of Comparative Example 1 was inferior in mechanical properties with a lower strength and in heat stability with a higher boiling water shrinkage percentage and, therefore, was not suitable for practical use.

In Comparative Example 2, the drafting speed was 7,500 m/min which was higher than the upper limit (6,500 m/min) specified in the present invention. Therefore, the filaments for the nonwoven fabric of Comparative Example 2 was inferior in draftability by the high-speed air streams with frequent filament breakage, thereby resulting in a lower productivity.

In Comparative Example 3, the press temperature of the embossing rolls was 175° C. which was higher than the melting point (117° C.) of the polymer, so that the web was fused on the embossing rolls. Therefore, it was impossible to form a nonwoven fabric.

EXAMPLE 10

A copolymer of L-lactic acid and D-lactic acid (L-lactic acid/D-lactic acid=99/1 mol %) having a melting point of 171° C. and an MFR of 40 g/10 min was employed. The copolymer was melt-spun into filaments through a circular spinneret at a spinning temperature of 200° C. at a mass out flow rate from each orifice of 1.83 g/min. The spun filaments were quenched by quench air streams, and then drafted at 5,500 m/min by an air sucker. The filaments were spread open each other and accumulated on a collector surface of a traveling conveyor thereby to be formed into a web. The web was then passed through an apparatus for partially bonding with heat and pressure which comprises embossing rolls so as to be partially bonded with heat and pressure under the following conditions: a press temperature of 110° C.; a fusion-bonded area percentage of 14.9%; a fusion-bonded spot density of 21.9 spots/cm$^2$; and a linear pressure of 5 kg/cm. Thus, a web comprised of filaments of 3.0 denier in single filament fineness and having a weight of 100 g/m$^2$ was obtained.

Then, two such webs were combined into a laminate, which was in turn subjected to a needle punching process at a punch density of 90 punches/cm$^2$ with a needle depth of 10 mm by means of a #40 regular barb punch. Thus, a filament nonwoven fabric was obtained in which the filaments were three-dimensionally entangled with each other with some temporary fusion-bonded spots remaining intact.

The physical properties of the filaments, the production conditions, the operability, and the physical properties and biodegradability of the nonwoven fabric are shown in Table 4.

TABLE 4

| | Ex. 10 | Ex. 11 | Ex. 12 | Ex. 13 |
|---|---|---|---|---|
| Physical properties of filaments | | | | |
| Molar ratio L/D | 99/1 | 99/1 | 99/1 | 99/1,99/1 |
| Tm (° C.) | 171 | 171 | 171 | 171,171 |
| MFR (g/10 min) | 40 | 40 | 40 | 40,40 |
| Birefringence ($\times10^{-3}$) | 15.2 | 15.2 | 15.2 | 15.1,13.8 |
| Degree of crystallinity (wt %) | 18.9 | 18.9 | 18.9 | 19.0,18.5 |
| Crystal size (Å) | 74 | 74 | 74 | 73.72 |
| Crystal orientation degree (%) | 95.8 | 95.8 | 95.8 | 95.6,95.3 |
| Production conditions for nonwoven fabric | | | | |
| Filament sectional configuration | *1 | *1 | *1 | *1 |
| Spinning temperature (° C.) | 200 | 200 | 200 | 200,200 |
| Mass out flow rate from each orifice (g/min) | 1.83 | 1.83 | 1.83 | 0.83,4.67 |
| Drafting speed (m/min) | 5500 | 5500 | 5500 | 5000,6000 |
| Press temperature (° C.) | 110 | 110 | 110 | 100,100 |
| Working temperature on one side (° C.) | — | 140 | 165 | 150 |
| Operability | | | | |
| Filament breakage resistance | ○ | ○ | ○ | ○, ○ |
| Physical properties of nonwoven fabric | | | | |
| Single filament fineness (d) | 3.0 | 3.0 | 3.0 | 1.5,7.0 |
| Weight per unit area (g/m$^2$) | 200 | 200 | 200 | 200 |
| Tensile strength (kg/5 cm width) | 17 | 20 | 21 | 19 |
| Compressive resilience (g) | — | 252 | 284 | 277 |
| Shrinkage percentage (%) | 4.2 | 4.2 | 4.0 | 4.2 |
| Biodegradability | ○ | ○ | ○ | ○ |
| Air permeability (cc/cm$^2$/sec) | — | 70 | 53 | 48 |

*1: Monocomponent circular sectional configuration

EXAMPLE 11

A filament nonwoven fabric was produced in the same manner as in Example 10 by needle punching, and one surface thereof was subjected to a heat treatment. More specifically, only one entire surface of a filament web subjected to the three-dimensional entanglement process as in Example 10 was fused by a calender of a surface temperature of 140° C. Thus, a filament nonwoven fabric having a weight per unit area of 200 g/m$^2$ was obtained. The physical properties of the filaments, the production conditions, the operability and the physical properties and biodegradability of the nonwoven fabric are shown in Table 4.

EXAMPLE 12

A filament nonwoven fabric was produced in substantially the same manner as in Example 11, except that the calender heat-treatment temperature was 150° C. The physical properties of the filaments, the production conditions, the operability and the physical properties and biodegradability of the nonwoven fabric are shown in Table 4.

EXAMPLE 13

A first filament nonwoven fabric was prepared in substantially the same manner as in Example 6 except that the weight thereof was 100 g/m$^2$ and the press temperature was 100° C., and a second filament nonwoven fabric was prepared in substantially the same manner as in Example 7 except that the weight thereof was 100 g/m$^2$ and the press temperature was 100° C. Then, the first and second filament nonwoven fabrics were combined into a laminate, which was in turn subjected to the needle punching process under the same conditions as in Example 10. Thereafter, the side of the first filament nonwoven fabric which had a smaller denier was subjected to the calender process at 150° C. under the same conditions as in Example 11. Thus, a nonwoven fabric was obtained. The physical properties of the filaments, the production conditions, the operability and the physical properties and biodegradability of the nonwoven fabric are shown in Table 4.

As apparent from Table 4, the filament nonwoven fabrics of Examples 10 to 13 were superior in mechanical strength. Further, the nonwoven fabrics of Examples 11 to 13 which were subjected to the process of calendering at least one surface of a filament web all over were each excellent in air- and water-shielding properties, and yet had an excellent biodegradability. This is proved by the fact that the nonwoven fabrics each had a great weight reduction rate and experienced a great shape change and a remarkable reduction in strength after being buried in the compost for the predetermined period.

COMPARATIVE EXAMPLE 4

The same polymer was melt-spun into filaments as in Example 1 through a circular spinneret at a spinning temperature of 200° C. at a mass out flow rate from each orifice of 0.82 g/min. The spun filaments were quenched, and then taken up as undrawn filaments at a surface speed of 1,000 m/min via a take-up roll. Then, the undrawn filaments were bundled, and heat-drawn at a draw ratio of 2.6 between a supply roll and a take-up roll. The drawn filaments were spread open each other by means of a corona charge opening apparatus and accumulated on a moving conveyor thereby to be formed into a web. Then, the web was introduced into an embossing apparatus as employed in Example 1 so as to be subjected to the process of partially bonding with heat and pressure at a roll temperature of 149° C. Thus, a nonwoven fabric comprised of filaments of 3.0 denier in single filament fineness and having a weight of 20 g/m$^2$ was obtained. The physical properties of the filaments, the production conditions, the operability and the physical properties and biodegradability of the nonwoven fabric are shown in Table 3.

The nonwoven fabric of Comparative Example 4, which was composed of the filaments spun at a lower speed and subjected to the hot drawing process had a higher polymer orientation degree and a higher polymer degree of crystallinity with a greater crystal size as measured axially of the filaments. Therefore, the nonwoven fabric was superior in thermal stability and mechanical properties. However, the constituent filaments were inferior in flexibility, so that the nonwoven fabric had a stiff and coarse texture.

What is claimed is:

1. A nonwoven fabric comprising monocomponent filaments of a polylactic acid based copolymer, wherein the polylactic acid based copolymer comprises a copolymer of D-lactic acid and L-lactic acid, having a melting point of not lower than 100° C., in which the copolymerization molar ratio of one of the D-lactic acid and L-lactic acid is not lower than 90% and that of the other is not more than 10%, or a blend of copolymers of D-lactic acid and L-lactic acid, having a melting point of not lower than 100° C., in which each of the copolymers has a different copolymerization molar ratio of the D-lactic acid and L-lactic acid within the range that the copolymerization molar ratio of one of the D-lactic acid and L-lactic acid is not lower than 90% and that of the other is not more than 10%, the filaments have a birefringence of $10\times10^{-3}$ to $25\times10^{-3}$, a degree of crystallinity of 12 to 30 wt % and a crystal size of not greater than 80 Å as measured axially of the filaments, the nonwoven fabric comprises filaments partially bonded to each other with heat and pressure to create fusion-bonded spots in a partially bonded area of the fabric, the nonwoven fabric having a boiling water shrinkage percentage of not higher than 15%, and a compressive resilience of not more than 150 g for each weight per unit area of 100 g/m$^2$, and the partial bonding with heat and pressure is effected so that each fusion-bonded spot has an area of 0.2 to 15 mm$^2$, distribution density of such fusion-bonded spots in a partially bonded area is 4 to 100 spots/cm$^2$, and a percentage of the fusion-bonded spot area to the partially fusion-bonded area is 3 to 50%.

2. A nonwoven fabric as set forth in claim 1, wherein the partially fusion-bonded spots are formed in spot fusion-bonded portions in which some of temporary fusion-bonded spots preliminarily formed on parts of the constituent filaments are de-bonded through a three-dimensional entanglement process, and the constituent filaments are three-dimensionally entangled with each other in non-fusion-bonded portions other than the spot fusion-bonded portions so as to be integrated to form the nonwoven fabric.

3. A nonwoven fabric as set forth in claim 2, wherein at least one surface of a filament web is bonded with heat and pressure all over.

4. A nonwoven fabric as set forth in claim 1, wherein at least one surface of a filament web is bonded with heat and pressure all over.

5. A nonwoven fabric as set forth in claim 1, wherein the constituent filaments have a single filament fineness of 1 to 12 denier.

6. A nonwoven fabric as set forth in claim 1, which has a weight of 10 to 500 g/m$^2$.

7. A nonwoven fabric as set forth in claim 1, which has a tensile strength of 10 kg/5 cm width per 100 g/m$^2$.

8. A nonwoven fabric comprising monocomponent filaments of a polylactic acid based copolymer, wherein the copolymer comprises a copolymer of D-lactic acid and L-lactic acid, having a melting point of not lower than 100° C., in which copolymerization molar ratio of one of the D-lactic acid and L-lactic acid is not lower than 90% and that of the other is not more than 10%, or a blend of copolymers of D-lactic acid and L-lactic acid, having a melting point of not lower than 100° C., in which each of the copolymers has a different copolymerization molar ratio of the D-lactic acid and L-lactic acid within the range that the copolymerization molar ratio of one of the D-lactic acid and L-lactic acid is not lower than 90% and that of the other is not more than 10%, the filaments have a birefringence of $10\times10^{-3}$ to $25\times10^{-3}$, a degree of crystallinity of 12 to 30 wt % and a crystal size of not greater than 80 Å as measured axially of the filaments, and the nonwoven fabric is integrally formed by completely de-bonding temporary fusion-bonded spots once formed on parts of the constituent filaments and three-dimensionally entangling the filaments through a three-dimensional entanglement process, the nonwoven fabric having a boiling water shrinkage percentage of not higher than 15%, and a compressive resilience of not more than 150 g for each weight per unit area of 100 g/m$^2$.

9. A nonwoven fabric comprising modified cross-section monocomponent filaments of a polylactic acid based copolymer, wherein the copolymer comprises a copolymer of D-lactic acid and L-lactic acid, having a melting point of not lower than 100° C., in which the copolymerization molar ratio of one of the D-lactic acid and L-lactic acid is not lower than 90% and that of the other is not more than 10%, or a blend of copolymers of D-lactic acid and L-lactic acid, having a melting point of not lower than 100° C., in which each of the copolymers has a different copolymerization molar ratio of the D-lactic acid and L-lactic acid within the range that the copolymerization molar ratio of one of the D-lactic acid L-lactic acid is not lower than 90% and that of the other is not more than 10%, the filaments have a degree of crystallinity of 12 to 30 wt % and a crystal size of not greater than 80 Å as measured axially of the filaments, and the nonwoven fabric comprises filaments partially bonded to each other with heat and pressure to create fusion-bonded spots in a partially bonded area of the fabric, the nonwoven fabric having a boiling water shrinkage percentage of not higher than 15% and a compressive resilience of not more than 150 g for each weight per unit area of 100 g/m$^2$, wherein the partial bonding with heat and pressure is effected so that each fusion-bonded spot has an area of 0.2 to 15 mm$^2$, a distribution density of the fusion-bonded spots in the partially bonded area is 4 to 100 spots/cm$^2$, and a percentage of the fusion-bonded spot area to the partially fusion-bonded area is 3 to 50%.

10. A nonwoven fabric as set forth in claim 9, wherein the partially fusion-bonded spots are formed in spot fusion-bonded portions in which some of temporarily fusion-bonded spots preliminarily formed on parts of the constituent filaments are de-bonded through a three-dimensional entanglement process, and the constituent filaments are three-dimensionally entangled with each other in non-fusion bonded portions other than the spot fusion-bonded portions so as to be integrated to form the nonwoven fabric.

11. A nonwoven fabric as set forth in claim 10, wherein at least one surface of a filament web is bonded with heat and pressure all over.

12. A nonwoven fabric as set forth in claim 9, wherein at least one surface of a filament web is bonded with heat and pressure all over.

13. A nonwoven fabric as set forth in claim 9, wherein the constituent filaments have a single filament fineness of 1 to 12 denier.

14. A nonwoven fabric as set forth in claim 9, which has a weight of 10 to 500 g/m$^2$.

15. A nonwoven fabric as set forth in claim 9, which has a tensile strength of 10 kg/5 cm width per 100 g/m$^2$.

16. A nonwoven fabric comprising modified cross-section monocomponent filaments of a polylactic acid based copolymer, wherein the copolymer is a copolymer of D-lactic acid and L-lactic acid, having a melting point of not lower than 100° C., in which the copolymerization molar ratio of one of the D-lactic acid and L-lactic acid is not lower than 90% and that of the other is not more than 10%, or a blend of copolymers of D-lactic acid and L-lactic acid, having a melting point of not lower than 100° C., in which each of the copolymers has a different copolymerization molar ratio of the D-lactic acid and L-lactic acid within the range that the copolymerization molar ratio of one of the D-lactic acid and L-lactic is not lower than 90% and that of the other is not more than 10%, the filaments have a degree of crystallinity of 12 to 30 wt % and a crystal size of not greater than 80 Å as measured axially of the filaments, and the nonwoven fabric is formed by completely de-bonding temporary fusion-bonded spots on parts of the constituent filaments and three-dimensionally entangling the filaments through a three-dimensional entangling process, the nonwoven fabric having a boiling water shrinkage percentage of not higher than 15%, and a compressive resilience of not more than 150 g for each weight per unit area of 100 g/m$^2$.

17. A method of producing a nonwoven fabric composed of polylactic acid based monocomponent filaments, the method comprising the steps of:

melting a polylactic acid based copolymer, which has a melt flow rate of 10 to 100 g/10 min as measured at 210° C. in conformity with ASTM-D-1238, at a temperature of (Tm+20)° C. to (Tm+80)° C. (wherein Tm is the melting point of the polylactic acid based copolymer), the polylactic acid based polymer being a copolymer of D-lactic acid and L-lactic acid, having a melting point of not lower than 100° C., in which copolymerization molar ratio of one of the D-lactic acid and L-lactic acid is not lower than 90% and that of the other is not more than 10%, or a blend of copolymers of D-lactic acid and L-lactic acid, having a melting point of not lower than 100° C., in which each of the copolymers has a different copolymerization molar ratio of the ID-lactic acid and L-lactic acid within the range that the copolymerization molar ratio of one of the D-lactic acid and L-lactic acid is not lower than 90% and that of the other Is not more than 10%;

extruding the resulting melt through a spinneret into monocomponent filaments;

drafting the resulting monocomponent filaments at a drafting speed of 3,000 to 6,500 m/min by means of a suction device; and then spreading open each other and accumulating the drafted monocomponent filaments on a movable collector surface thereby to form a web; and partially bonding the web with heat and pressure at a temperature lower than the melting point of the copolymer to form fusion-bonded spots, whereby each fusion-bonded spot has an area of 0.2 to 15 mm$^2$, a distribution density of the fusion-bonded spots in the web is 4 to 100 spots/cm$^2$, and a percentage of the fusion-bonded spot area to the total web area is 3 to 50%.

18. A production method as set forth in claim 17, wherein the web is partially bonded with heat and pressure to form temporary fusion-bonded spots therein, further comprising the step of three-dimensionally entangling the web to de-bond at least some of the filaments in the temporary fusion-bonded spots.

19. A production method as set forth in claim 18, wherein the temporary fusion-bonded spots are formed by partially bonding the web with heat and pressure by means of an embossing roll at a roll linear pressure of 5 to 30 kg/cm at a working temperature of (Tm−80)° C. to (Tm−50)° C., where Tm is the lowest one of the melting points of the polymer components of the filaments.

20. A production method as set forth in claim 18, wherein the web formed by spreading and accumulating the filaments on the movable collector surface is applied with the partial bonding with heat and pressure and three-dimensional entangling, and thereafter at least one surface of the web is bonded with heat and pressure all over.

21. A production method as set forth in claim 17, wherein the partial bonding with heat and pressure is applied onto the web formed by spreading and accumulating the filaments on the movable collector surface at a temperature not higher than the melting point of the polylactic acid based copolymer, and thereafter at least one surface of the web is bonded with heat and pressure all over.

22. A production method as set forth in claim 21, wherein at least one surface of the web is bonded with heat and pressure all over by means of a roll at a temperature of not higher than (Tm−10)° C. (wherein Tm is the melting point of the polylactic acid based polymer) at a roll linear pressure of not lower than 0.01 kg/cm.

* * * * *

UNITED STATES PATENT AND TRADEMARK OFFICE

CERTIFICATE OF CORRECTION

PATENT NO. : 6,607,996 B1
DATED : August 19, 2003
INVENTOR(S) : Matsunaga et al.

It is certified that error appears in the above-identified patent and that said Letters Patent is hereby corrected as shown below:

Title page,
Item [73], Assignee, delete "Tomoegawa Paper Co., Ltd., Tokyo (JP);"

Signed and Sealed this

Twentieth Day of January, 2004

JON W. DUDAS
*Acting Director of the United States Patent and Trademark Office*